US011846132B2

(12) United States Patent
Stranger et al.

(10) Patent No.: US 11,846,132 B2
(45) Date of Patent: Dec. 19, 2023

(54) SMART HATCH AUTONOMOUS ACTUATION SYSTEMS FOR HATCHES WINDOWS AND DOORS

(71) Applicants: James Stranger, Chino, CA (US); Brittany Stone, Chino, CA (US)

(72) Inventors: James Stranger, Chino, CA (US); Brittany Stone, Chino, CA (US)

( * ) Notice: Subject to any disclaimer, the term of this patent is extended or adjusted under 35 U.S.C. 154(b) by 0 days.

(21) Appl. No.: 17/182,010

(22) Filed: Feb. 22, 2021

(65) Prior Publication Data

US 2021/0262273 A1 Aug. 26, 2021

Related U.S. Application Data

(60) Provisional application No. 63/030,294, filed on May 26, 2020, provisional application No. 63/026,715,
(Continued)

(51) Int. Cl.

| | |
|---|---|
| ***E05F 15/616*** | (2015.01) |
| ***E05F 15/71*** | (2015.01) |
| ***E05B 47/00*** | (2006.01) |
| ***E05C 3/00*** | (2006.01) |
| ***E05C 3/08*** | (2006.01) |

(Continued)

(52) U.S. Cl.

CPC ..... *E05F 15/616* (2015.01); *B63B 19/14* (2013.01); *B65F 1/1638* (2013.01); *E05B 13/004* (2013.01); *E05B 17/0029* (2013.01); *E05B 47/0012* (2013.01); *E05C 3/008* (2013.01); *E05C 3/08* (2013.01); *E05F 1/00* (2013.01); *E05F 15/71* (2015.01); *E05B 2047/002* (2013.01); *E05B 2047/0023* (2013.01); *E05C 9/08* (2013.01); *E05Y 2201/434* (2013.01); *E05Y 2201/626* (2013.01); *E05Y 2400/40* (2013.01); *E05Y 2400/44* (2013.01)

(58) Field of Classification Search

USPC ..... 114/201 R, 202, 203, 201 A

See application file for complete search history.

(56) References Cited

U.S. PATENT DOCUMENTS 3,183,873 A * 5/1965 Hamilton ..... B63B 19/197 49/249
3,209,392 A * 10/1965 Levine ..... E05F 1/1261 114/201 R (Continued)

FOREIGN PATENT DOCUMENTS

EP 1087080 A2 3/2001
GB 2133831 A * 8/1984 ..... B63B 19/14

(Continued)

*Primary Examiner* — Marcus Menezes

(74) *Attorney, Agent, or Firm* — Lynch LLP; Sean Lynch

(57) ABSTRACT

Systems and methods described in this application are directed to hatch lid actuation systems. Actuation systems of the inventive subject matter are configured to effect the opening and closing of lids that are hingedly coupled with an opening. An embodiment featuring a rotational actuator, e.g., a motor, as well as an embodiment featuring a linear actuator are described. Embodiments having rotational actuators can additionally feature a gearbox. Embodiments of the inventive subject matter can also include sensor packages that can determine various hatch lid conditions (e.g., whether a lid is open, closed, wet, etc.).

12 Claims, 8 Drawing Sheets

Related U.S. Application Data filed on May 18, 2020, provisional application No. 62/979,124, filed on Feb. 20, 2020.

(51) Int. Cl.

| | |
|---|---|
| ***E05F 1/00*** | (2006.01) |
| ***B65F 1/16*** | (2006.01) |
| ***B63B 19/14*** | (2006.01) |
| ***E05B 17/00*** | (2006.01) |
| ***E05B 13/00*** | (2006.01) |
| *E05C 9/08* | (2006.01) |

(56) References Cited

U.S. PATENT DOCUMENTS 4,004,538 A * 1/1977 Schoonman ..... B63B 19/26 114/201 R
4,497,135 A * 2/1985 Vetter ..... E05D 15/30 49/252
4,663,495 A * 5/1987 Berman ..... H01L 31/022475 180/2.2
4,811,680 A * 3/1989 Genth ..... B63B 19/14 114/211
5,140,771 A * 8/1992 Moy ..... E05F 15/622 49/343
5,161,478 A * 11/1992 Strieb ..... B63B 19/06 114/361
RE36,436 E * 12/1999 Kyle ..... B63B 19/08 49/386
6,006,475 A * 12/1999 Schwantes ..... E05F 15/63 49/140
6,135,536 A * 10/2000 Ciavaglia ..... E05F 15/614 49/335
6,634,140 B1 * 10/2003 Sellman ..... E05F 15/63 49/340
7,004,096 B1 * 2/2006 Beal ..... B63B 19/14 114/201 R
7,310,911 B1 * 12/2007 Sellman ..... E05F 15/41 49/340
8,453,589 B2 * 6/2013 Czarnowski ..... B63B 19/14 114/201 R
8,688,329 B2 4/2014 Cathcart
10,526,049 B1 * 1/2020 Helton ..... B63B 19/24
10,597,228 B1 * 3/2020 Yao ..... B65F 1/1646
10,717,597 B2 * 7/2020 Shek ..... B65F 1/1607
10,883,298 B2 * 1/2021 Hsieh ..... E05F 15/614
11,203,893 B2 * 12/2021 Soderqvist ..... E05F 15/63
11,230,434 B1 * 1/2022 Sansone ..... B65F 1/1646
2004/0011266 A1 * 1/2004 Rabal ..... B63B 19/14 114/201 R
2005/0073425 A1 * 4/2005 Snell ..... E05F 15/00 340/545.1
2005/0258794 A1 * 11/2005 Fukuizumi ..... B65F 1/1638 318/480
2006/0071504 A1 * 4/2006 Ishihara ..... E05F 15/63 296/146.4
2006/0236610 A1 * 10/2006 Barnum ..... E05D 13/1253 49/379
2006/0237989 A1 * 10/2006 Kuan ..... E05F 15/614 296/76
2008/0100189 A1 * 5/2008 Huber ..... A47B 88/463 312/319.1
2009/0084300 A1 * 4/2009 Kyle ..... B63B 19/26 114/201 R
2009/0265992 A1 * 10/2009 Hass ..... E05F 15/63 318/610
2010/0066120 A1 * 3/2010 Etou ..... B60J 5/101 296/146.4
2010/0176128 A1 * 7/2010 Nance ..... B65F 1/1638 220/211
2010/0251519 A1 * 10/2010 Duffy ..... E05F 15/63 16/382
2010/0308045 A1 * 12/2010 Tong ..... B65F 1/08 220/211
2012/0023824 A1 * 2/2012 Mason ..... E05F 15/622 49/340
2012/0072034 A1 * 3/2012 Cathcart ..... G05D 23/19 700/282
2013/0091769 A1 * 4/2013 Medema ..... E05F 15/619 49/70
2013/0220198 A1 * 8/2013 Schmidt ..... B63J 99/00 114/201 R
2014/0311394 A1 * 10/2014 Ferretti ..... B63B 27/36 114/201 R
2015/0096233 A1 * 4/2015 Kojima ..... E05F 15/40 49/31
2016/0290027 A1 * 10/2016 Schmidt ..... E05F 15/63
2017/0084144 A1 * 3/2017 Ricks ..... E05D 11/00
2017/0320639 A1 * 11/2017 Shek ..... B65F 1/1646
2018/0163453 A1 * 6/2018 Attee ..... E05F 11/08
2018/0229930 A1 * 8/2018 Shek ..... B65F 1/1638
2018/0245387 A1 * 8/2018 Suzuki ..... E05D 7/081
2019/0128038 A1 * 5/2019 Hsieh ..... G03B 21/145
2020/0355007 A1 * 11/2020 Aceto ..... F16H 19/001
2021/0061558 A1 * 3/2021 Shek ..... B65F 1/1638
2021/0180389 A1 * 6/2021 Plummer ..... E05F 15/63

FOREIGN PATENT DOCUMENTS

WO WO-2016164023 A1 * 10/2016 ..... E05F 15/611
WO WO-2018133184 A1 * 7/2018 ..... B65F 1/06
WO WO-2019055299 A1 * 3/2019 ..... E05F 15/616
WO WO-2020128837 A1 * 6/2020 ..... E05F 15/63

* cited by examiner

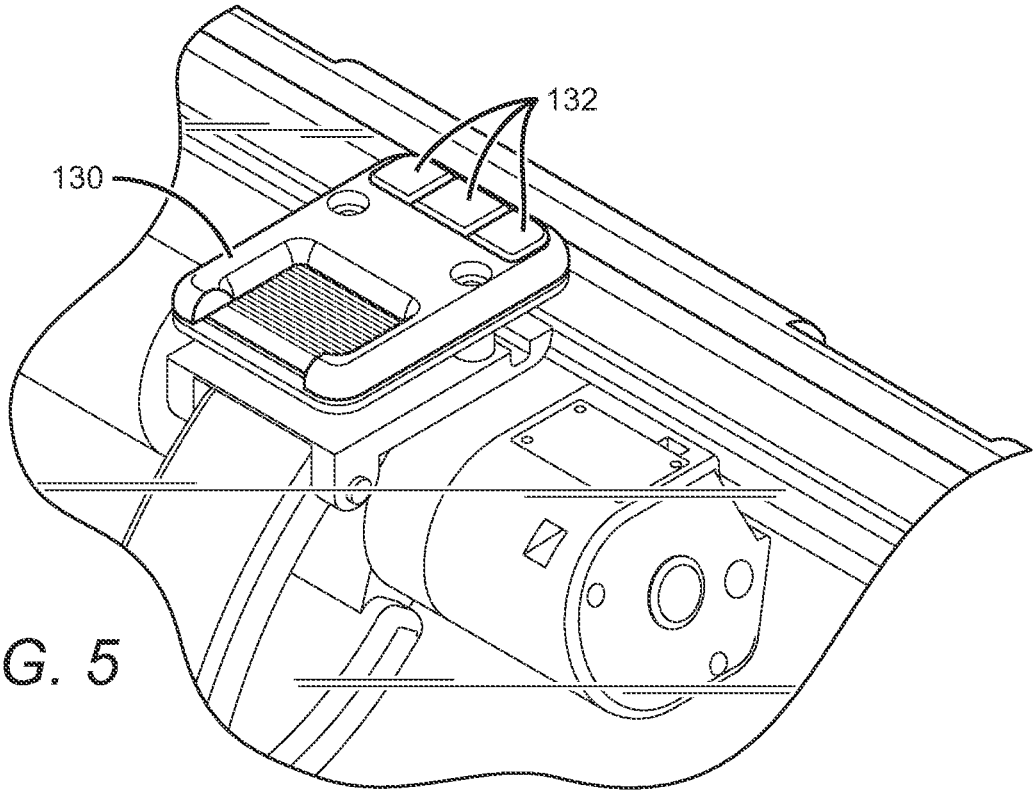
FIG. 5
FIG. 6
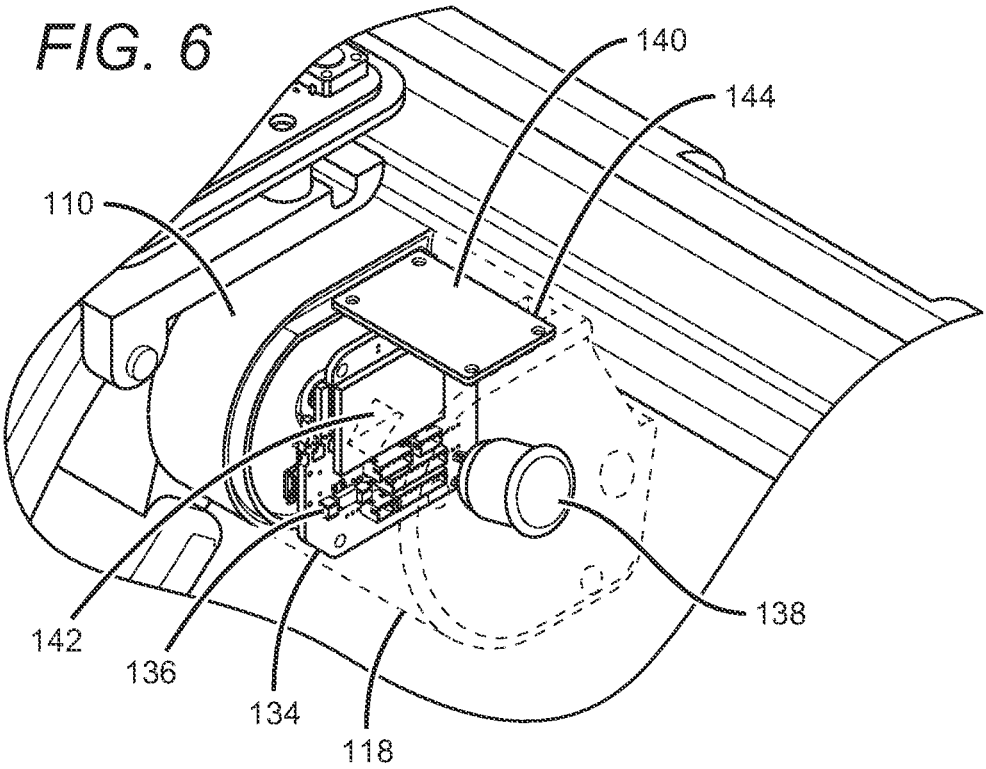

SMART HATCH AUTONOMOUS ACTUATION SYSTEMS FOR HATCHES WINDOWS AND DOORS

This application claims priority to U.S. Provisional Patent Application No. 63/030,294 filed May 26, 2020; U.S. Provisional Patent Application No. 63/026,715 filed May 18, 2020; and U.S. Provisional Patent Application No. 62/979,124 filed Feb. 20, 2020. All extrinsic materials identified in this application are incorporated by reference in their entirety.

FIELD OF THE INVENTION

The field of the invention is opening/closing systems for hatches, doors, windows, and other hinge-based openings.

BACKGROUND

The background description includes information that may be useful in understanding the present invention. It is not an admission that any of the information provided in this application is prior art or relevant to the presently claimed invention, or that any publication specifically or implicitly referenced is prior art.

Boats, buildings, ships, watercraft, cars, cruise ships, RVs, mobile homes, buses, aircraft, vans, structures, animal enclosures, and all other manner of vehicles and vessels that have an interior space often incorporate hatches or doors that can open that interior space out to the exterior. For example, a boat's cabin can include one or more hatches to, among other things, facilitate airflow and to allow for ingress and egress. Until now, these components have gone largely unchanged, despite many advancements in technology that have brought about smaller, more powerful actuators that require less energy to use, as well as better electronics to facilitate control systems and to allow for wireless communication and control. There exists a need for low energy consuming actuation systems that can facilitate automated locking and unlocking as well as opening and closing.

One example of an effort to improve on existing boat hatches is U.S. Pat. No. 8,688,329 to Cathcart. This patent is directed to a hatch having a linear actuator that can be used to open and close the hatch. But the Cathcart patent fails to contemplate many different improvements that can be implemented using newer technologies, and it similarly fails to contemplate more advanced locking/lifting mechanisms.

Examples of improved watercraft hatches are few and far between, but even innovations in other fields, such as car doors, indicate there is ample room for improvement. European Patent Application No. 1087080 is directed to car door systems as opposed to marine door systems.

But even this application fails to consider new mechanisms and systems described in this application that can be implemented to cause a door to swing open, and it similarly fails to consider using a variety of different sensors to automate opening and closing of the door.

Thus, there still exists a need in the art for improved hatches for various uses e.g., in watercraft, vehicles, structures, and other applications.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

SUMMARY OF THE INVENTION

The present invention provides apparatuses, systems, and methods directed to opening and closing systems. In one aspect of the inventive subject matter, a lid actuation system is contemplated comprising: an actuation subsystem having a motor, a gearbox coupled with the motor, a lever arm coupled with the gearbox, and a linkage coupled with the lever arm; where the actuation subsystem is configured to couple with a base; a lid subsystem having a lid bracket coupled with the linkage; and wherein the lid bracket is configured to couple with the lid that is hingedly coupled with the base.

In some embodiments, the system also includes a first sensor package and a second sensor package, wherein the first sensor package is coupled with the actuation subsystem and the second package is coupled with the lid bracket. In some embodiments, the first sensor package comprises at least one of a water sensor, a hygrometer, an anemometer, a barometer, a thermometer, a MEMS gyroscope, a MEMS accelerometer, and a MEMS magnetometer.

The second sensor package can include at least one of a water sensor, a hygrometer, an anemometer, a barometer, a thermometer, a MEMS gyroscope, a MEMS accelerometer, and a MEMS magnetometer. In some embodiments, the system also has an additional sensor package with sensors that can be exposed to the environment comprises at least one of a water sensor, a hygrometer, an anemometer, a barometer, a thermometer, and a carbon monoxide sensor.

In some embodiments, the system also has an enclosure configured to at least partially enclose the sensor package, wherein the enclosure has an air inlet and an air outlet to allow air currents to pass over the exposed sensors contained therein. The second sensor package can also have a cover and at least one input.

In some embodiments, the system additionally includes a rotary encoder coupled with the motor. The lever arm can also have a curved portion and the linkage can have a curved portion.

In some embodiments, a torsion spring is coupled with the lever arm. Some systems also have a tension hinge coupled with the lever arm, and in some embodiments, the system includes a solar panel.

In another aspect of the inventive subject matter, a lid actuation system is contemplated comprising: an actuation subsystem having a lever arm coupled with a linkage, a linkage coupled with a lid bracket configured to couple with the lid, and a linear actuator coupled to the lever arm at a first end and coupled to the linkage at a second end; wherein the actuation subsystem is configured to couple with a base; a lid subsystem having a lid bracket coupled with the linkage; and wherein the lid bracket is configured to couple with the lid that is hingedly coupled with the base.

The system can also include a first sensor package and a second sensor package, wherein the first sensor package is coupled with the base and the second package is coupled with the lid. In some embodiments, the first sensor package comprises at least one of a water sensor, a hygrometer, an anemometer, a barometer, a thermometer, a MEMS gyroscope, a MEMS accelerometer, and a MEMS magnetometer.

The second sensor package can include at least one of a water sensor, a hygrometer, an anemometer, a barometer, a thermometer, a MEMS gyroscope, a MEMS accelerometer, and a MEMS magnetometer. Systems can also have an additional sensor package with sensors that can be exposed to the environment comprises at least one of a water sensor, a hygrometer, an anemometer, a barometer, a thermometer, and a carbon monoxide sensor. The second sensor package can also include a cover and at least one input.

In some embodiments, the system includes an enclosure configured to at least partially enclose the sensor package, wherein the enclosure has an air inlet and an air outlet to allow air currents to pass over the exposed sensors contained therein.

In some embodiments, a rotary encoder is coupled with the motor. The linkage can include a linkage slot and wherein the lever arm comprises a lever slot, and wherein the first end of the linear actuator couples to the lever arm within the lever slot at a first coupling point and where the second end of the linear actuator couples to the linkage within the linkage slot at a second coupling point. In some embodiments, the first coupling point is disposed on a coupling bracket that is itself disposed at least partially within the linkage slot.

The system can also include a torsion spring coupled with the lever arm, and the system can include a tension hinge coupled with the lever arm. The system can also include a solar panel.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 5 is a close view of the sensor package with a cover disposed thereon of the actuation system of FIG. 1.

FIG. 6 is a close view showing a computing device implementing the actuation system of FIG. 1.

DETAILED DESCRIPTION

Figure 1:
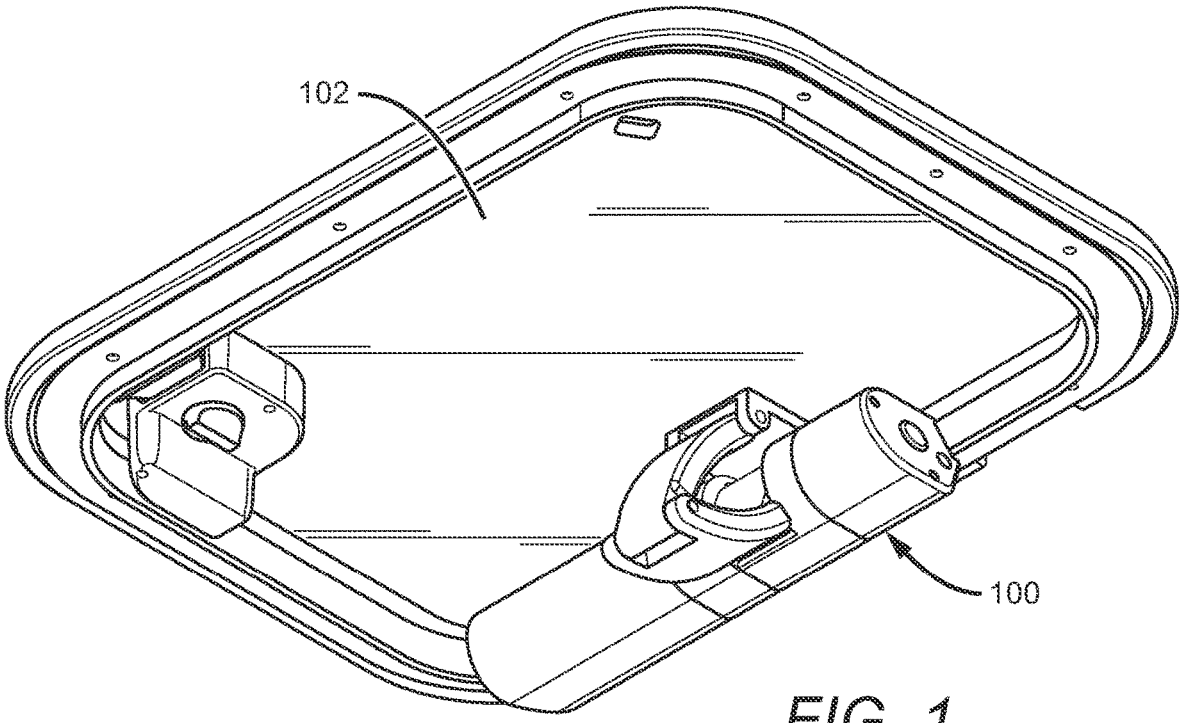
FIG. 1 is an underside view of a hatch implementing an actuation system of the inventive subject matter.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

It should be noted that any language directed to a computer should be read to include any suitable combination of computing devices, including servers, interfaces, systems, databases, agents, peers, Engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network. The following description includes information that may be useful in understanding the present invention. It is not an admission that any of the information provided in this application is prior art or relevant to the presently claimed invention, or that any publication specifically or implicitly referenced is prior art.

Embodiments of the inventive subject matter can be incorporated into hatches on boats and other watercraft. Although the examples below can be interpreted as pertaining specifically to boats and other watercraft, the inventors specifically contemplate implementing embodiments into any manner of buildings, structures, equipment, mining facilities, aircraft, vessels, animal enclosures and vehicles that have opening doors or windows that could benefit from automated and electronic control. For example, in the context of a building, skylights in many homes are difficult to reach and would benefit from a system that allows for both remote control and for automated control based on, e.g., environmental conditions and user preferences. As such, in this application, the term "lid" without a modifier preceding it (e.g., "hatch lid") should be interpreted to refer to a hinged cover of an opening, where that opening can be a door, a window, a hatch, etc.

Embodiments of the inventive subject matter improve on existing, simple hatch systems by creating an electric and automated hatch that can be responsive to atmospheric and weather conditions using on-board sensors and other external weather databases to determine whether a hatch should or can be opened or closed. Embodiments include a motorized opening mechanism, a motorized locking mechanism, a manual override (e.g., for the locking mechanism, the opening mechanism, or both), an optional solar and battery backup in case of electrical failure, as well as inputs such as buttons, switches, touch screen(s), or even a wireless module to receive remote signals, e.g., from a phone app or from a set of controls in a location other than where the automation system is implemented. Accordingly, some embodiments include helm controls or other remote inputs. It is contemplated that, e.g., helm controls can be incorporated into existing controls at the helm of a vessel (e.g., via a wired, WiFi, Bluetooth or other type of connection) to tie into an existing control systems such as NMEA 2000 or those made by Raymarine, Foruno, etc. In some embodiments, separate controls can be added to a helm (e.g., a separate touch screen display can be mounted at the helm). It is also contemplated that controls can be mounted in a location other than the helm, or, in some embodiments, remote controls can be placed in multiple locations around a vessel. In contexts outside of watercraft, "helm controls" should be interpreted as being equivalent to remote controls or control panels.

Figure 2:
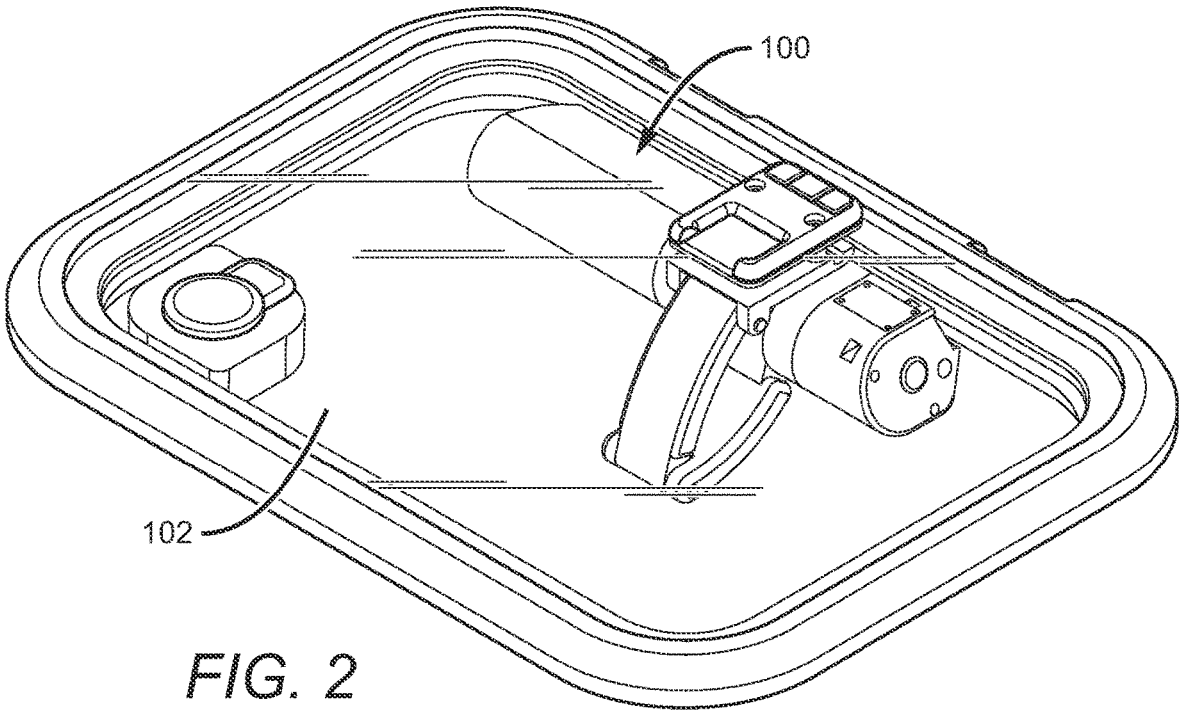
FIG. 2 is a top, perspective view thereof.

The inventive subject matter described in this application is directed to systems and methods for opening, closing, and locking/unlocking hatches or other openings that have a hinge-based door. FIGS. 1 and 2 show a hatch having a hatch actuation system of the inventive subject matter. FIG. 1 shows hatch actuation system 100 from below hatch lid 102, while FIG. 2 shows hatch actuation system 100 from above hatch lid 102. As shown in these figures, some aspects of hatch actuation system 100 exist on an exterior side of hatch lid 102, while the majority of its components are disposed on an interior side.

Figure 3:
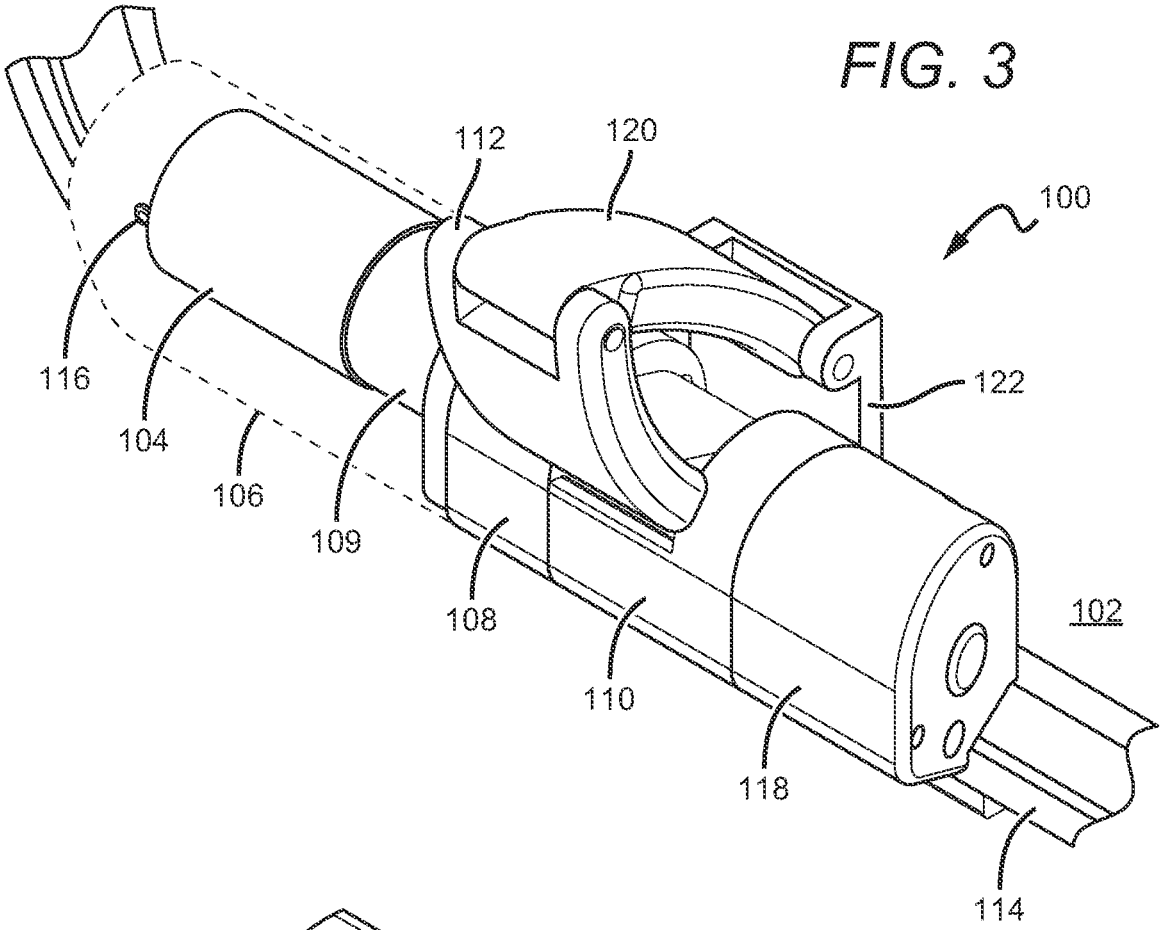
FIG. 3 is a close view thereof.

Actuation system 100 includes a variety of components, many of which can be seen in FIG. 3. For example, it features a motor 104 disposed within enclosure 106. Motor 104 couples with motor mount 108 and gearbox 109 and is coupled with mounting component 110. Mounting component 110 separates motor 104 and motor mount 108 from lever arm 112. Lever arm 112 couples directly with output from motor 104 such that causing motor 104 to rotate in turn causes lever arm 112 to rotate.

Enclosure 106 protects motor 104, encoder 116 and gearbox 109 from interference by external factors (e.g., dust, dirt, water, damage, etc.). Mounting component 110 fixedly couples with hatch base 114 and further couples (i.e., either directly or indirectly via one or more of the listed components) with motor 104, motor mount 108, gearbox 109, encoder 116, and lever arm 112. Output from motor 104 is mechanically coupled to lever arm 112 via gearbox 109, thus creating greater torque to cause hatch lid 102 to open. When motor 104 is activated, lever arm 112 rotates, causing linkage 120 to press against lid bracket 122, which is coupled with hatch lid 102. All the while, mounting component 110 remains stationary relative to (and, in some embodiments, fixed to) hatch base 114. Hatch lid 102 is thus caused to open by motor 104.

Linkage 120 thus couples with lever arm 112 and with lid bracket 122. Lid bracket 122 couples with the lid portion of a hatch, and linkage 120 is coupled with the lid bracket 122 by a pin joint, allowing for unimpeded rotation with a single degree of freedom at the coupling point. Lid bracket 122 can be coupled with the hatch lid 102 by, e.g., one or any combination of fasteners that pass-through hatch lid 102, by an adhesive, or, in some embodiments, the lid bracket 122 can be included as an integral part of the hatch lid itself. Both lever arm 120 and linkage 112 can be formed to include a curve, where such a curve can improve the system's ability to open hatch lid to 180 degrees and beyond upon actuation. Lever arm 120 and linkage 112 can feature matching curves. In some embodiments, lever arm 120 and linkage 112 do not have any curves.

A torsion spring can be incorporated into, e.g., motor mount 108, mounting component 110, lever arm 112, and such a torsion spring could create an opening bias that reduces the amount of torque required to cause hatch lid 102 to be opened from a closed configuration. In some embodiments, such a torsion spring could be incorporated to bias a hatch lid 102 into a closed configuration. In some embodiments, multiple torsion springs can be implemented. Torsion springs can be made from, e.g., 3.5 mm diameter stainless steel wire. For example, a torsion spring can be incorporated to cause a hatch to naturally pop at least slightly open from a fully closed position due to force from the spring. Torsion springs can be used to counterbalance the weight of the hatch lid 102 such that the torque applied by the torsion springs in combination with the back-drive torque of the motor can hold the hatch lid at any angle without requiring any electrical energy. Torsion springs also reduce the load on the motor. In still further embodiments, no torsion springs are included at all.

In some embodiments, as described above, motor 104 interacts with gearbox 109 to open or close the hatch lid 102. Using a rotating motor in systems of the inventive subject matter instead of a linear actuator (as described below) can confer several benefits including an unrestricted range of motion, reduced obstruction of a hatch opening, and reduced protrusion into the interior space that could result from using a linear actuator. For example, with a rotational motor such as motor 104, hatch lid 102 can open a full 180 degrees or more, such as when a hatch lid 102 is seated on an opening that extrudes from surrounding surfaces, making it possible for hatch lid 102 to rotate more than 180 degrees while opening.

Some motors additionally include a rotary encoder 116. Rotary encoder 116 is shown on one end of the motor 104 in FIG. 3. Some types of motors, such as servo motors, require no additional hardware to track the motor's angular position, but other motors, such as DC motors, require a rotary encoder to keep track of angular position. Angular position of motor 104 can be used in some embodiments to set limits for the motor's rotation. For example, in an embodiment where going from a fully closed hatch lid 102 to a fully open hatch lid 102 requires motor 104 to turn 30 times, rotary encoder 116 can count those revolutions to ensure that hatch lid 102 is fully opened when, e.g., a user provides an input to cause hatch lid 102 to open. Setting such a limit can help prevent damage to motor 104, gearbox 109, motor mount 108, lever arm 112, linkage 120, or other components of such a system. In the same way a limit can be set to stop a hatch once it is fully opened, intermediate limits can be set at any degree to allow a motor to open a hatch 10%, 20%, 30%, 40%, 50%, 60%, 70%, 80%, or 90%, or any amount therebetween up to 100% open.

Figure 4:
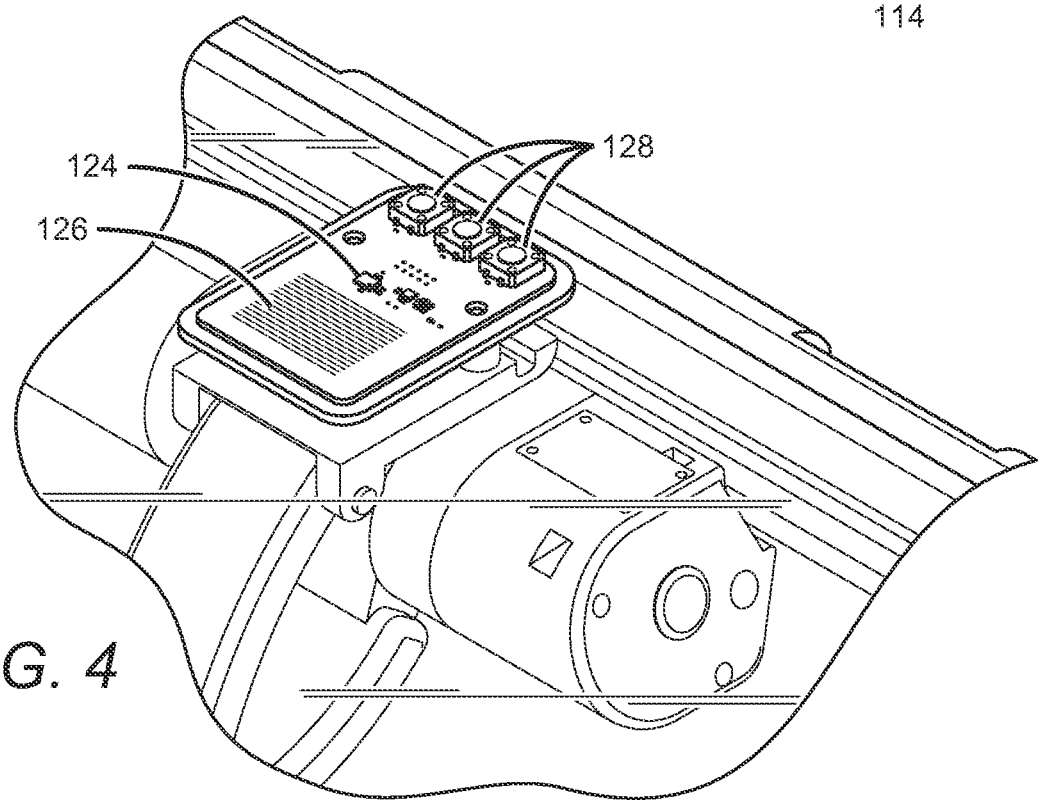
FIG. 4 is a close view of a sensor package implemented into the actuation system of FIG. 1.

Other sensors can be included, and FIG. 4 shows an integrated circuit coupled with lid bracket 122, where the integrated circuit has at least one sensor package 124 (e.g., a MEMS gyroscope), though, in some embodiments, the integrated circuit can include one or any combination of a gyroscope, an accelerometer, a magnetometer, an air pressure sensor, humidity sensor, temperature sensor, a carbon monoxide sensor, and a wind speed sensor (e.g., either as separate MEMS components or as a single package sensor component, which can be represented by 124). In some embodiments, integrated circuit further includes a water sensor 126 and user interface hardware 128 for controlling the system 100. User interface hardware can include, e.g., physical buttons while in some embodiments it includes touch-based (e.g., capacitive or resistive touch interfaces) or touch-free input components (e.g., proximity-based interfaces). In some embodiments, integrated circuit can additionally include input/output leads that allow for the integrated circuit to form a wired connection with a computing device (e.g., a standard serial connection such as a USB connection). In some embodiments, the integrated circuit can additionally include a wireless module (e.g., Bluetooth, ZigBee Wave, Z-Wave, WiFi, etc.) capable of transmitting information gathered from sensor package 124 to a computing device. FIG. 5 shows a cover 130 over the integrated circuit, where cover 130 additionally features button cover 132. Cover 130 features an unobstructed path for water to drain off the water sensor (shown as the gap in material along an edge of the cover).

FIG. 6 shows computing device 134 (pictured as a circuit board with constituent components thereon), which is disposed within electronics enclosure 118 (shown as a semi-transparent component in FIG. 6 so elements disposed therewithin are visible). Electronics enclosure 118 is coupled to mounting component 110. Computing device 134 can feature an additional sensor package 136. Sensor package 136 can be, e.g., the same sensor package as the sensor package shown in FIG. 4 and described above. Sensor package 136 can additionally or alternatively include one or any combination of a, e.g., MEMS gyroscope, a MEMS accelerometer, and a MEMS magnetometer, or any other MEMS sensor or sensor package, including duplicate sensors (e.g., either the same or different but performing the same functions) to improve reliability through redundancy. Sensor package 136 can be included in some embodiments as a reference sensor, where sensor package 136 is mounted on a non-moving portion of the structure, vessel, or vehicle that a hatch is placed on. For example, if a hatch is placed on a boat and automated using an embodiment of the inventive subject matter, sensor package 136 could be mounted on the hatch's stationary frame (e.g., a hatch base) or on another portion of the boat that moves with the entire boat (e.g., not on a door, window, or any other component that can move independently from the body of the boat).

In embodiments with two sensor packages, one, like sensor package 136, that remains stationary relative to a hatch base and one like sensor package 124 that rotates with hatch lid 102, sensor package 136 provides reference measurements that can be compared to measurements from sensor package 124. Thus, a computing device (e.g., a phone, a computer, or other specialized electronics capable of processing sensor data) can receive measurements from sensor packages 124 and 136 as input, compare those measurements, and determine a hatch's position relative to a structure onto which it is mounted (e.g., a hatch base), even when that structure is moving (e.g., when the structure is part of a boat, a motor vehicle, etc.). Because systems of the inventive subject matter can be incorporated into moving vehicles, an absolute reference frame (e.g., a reference frame that does not account for movements of the vehicle) may not always be useful. By including sensor package 136, a reference frame is created that accounts for movements of a vehicle (e.g., boat, car, etc.), thus making measurements from sensor package 124 more useful in determining a hatch lid's position despite unpredictable movements. Both sensor packages 124 & 136 can thus transmit measurements to a computing device where those measurements can be compared to determine a position and orientation of hatch lid 102.

In some embodiments, a button/switch 138 having an LED (e.g., an RGB LED) is coupled with electronics enclosure 118 and forms a watertight seal using, e.g., a rubber O-ring, an adhesive, or both. The button/switch 138 can be used to control the hatch. An LED can provide feedback to the user using, e.g., different colors, flashing sequences, or solid light indicating different system states, errors, etc. In some embodiments, additional sensor package 140 can be coupled to electronics enclosure 118, and it can comprise sensors that can be exposed to the ambient environment such as one or any combination of a water sensor, an air pressure sensor, humidity sensor, temperature sensor, a carbon monoxide sensor, and a wind speed sensor. Electronics enclosure 118 has a cavity having air inlet 142 and outlet 144 to allow air currents to pass over the exposed sensors contained therein.

In the event of, e.g., component failure, some embodiments allow for manual opening and closing of a hatch lid. Thus, in some embodiments, the motor can be back driven to manually open or close the hatch lid. To manually open a hatch having a worm-gear motor, the lifting mechanism can first be disengaged. Lifting mechanisms can be disengaged in, e.g., several different ways, including by removing one or more axial shaft (e.g., a shaft coupling the lever arms to a linkage or a shaft coupling a linkage to lid bracket) using a pull-pin.

It is additionally contemplated that embodiments of the inventive subject matter can further include a clutch to facilitate manual operation of the hatch. A clutch can be configured to disengage the lifting mechanisms (e.g., it can cause lever arm 112 to disengage from the motor's or gearbox's output) when excessive force is applied. This can prevent accidental damage to the motor or other components of the system. A clutch can be incorporated into, e.g., mounting component 110, and such a clutch can prevent damage during unintended or unexpected events such as someone stepping on a partially open hatch (e.g., a hatch that is open 10-20 degrees), extreme wind conditions, debris, and an incoming wave that would otherwise damage the lifting mechanisms.

Figure 7A:
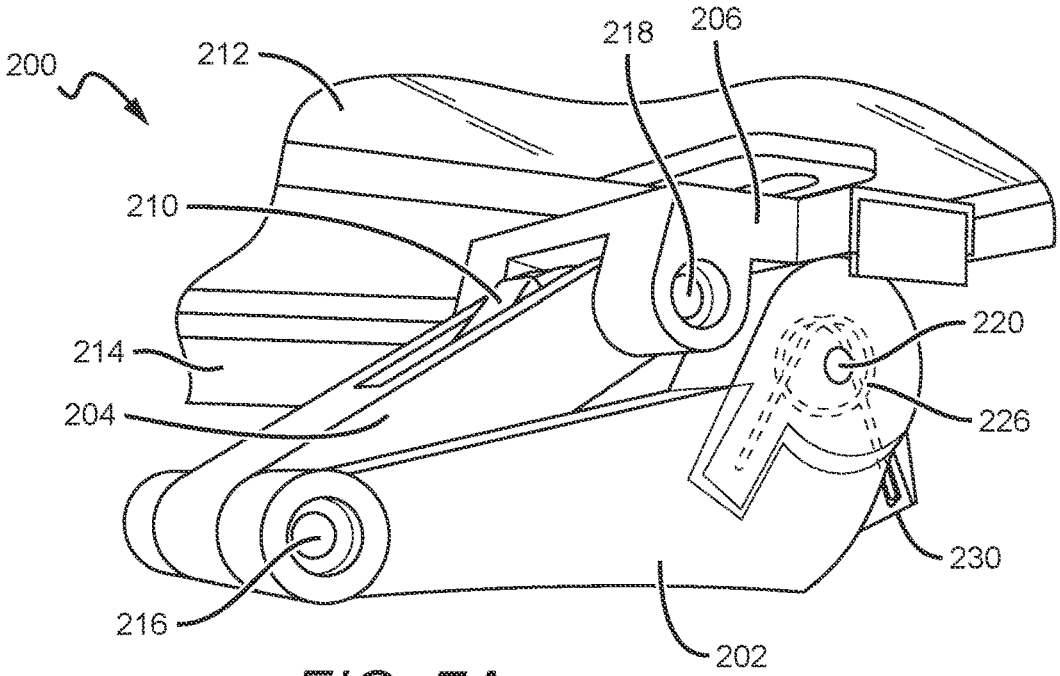
FIG. 7A shows another actuation system of the inventive subject matter with the actuation system in a closed configuration.
Figure 7B:
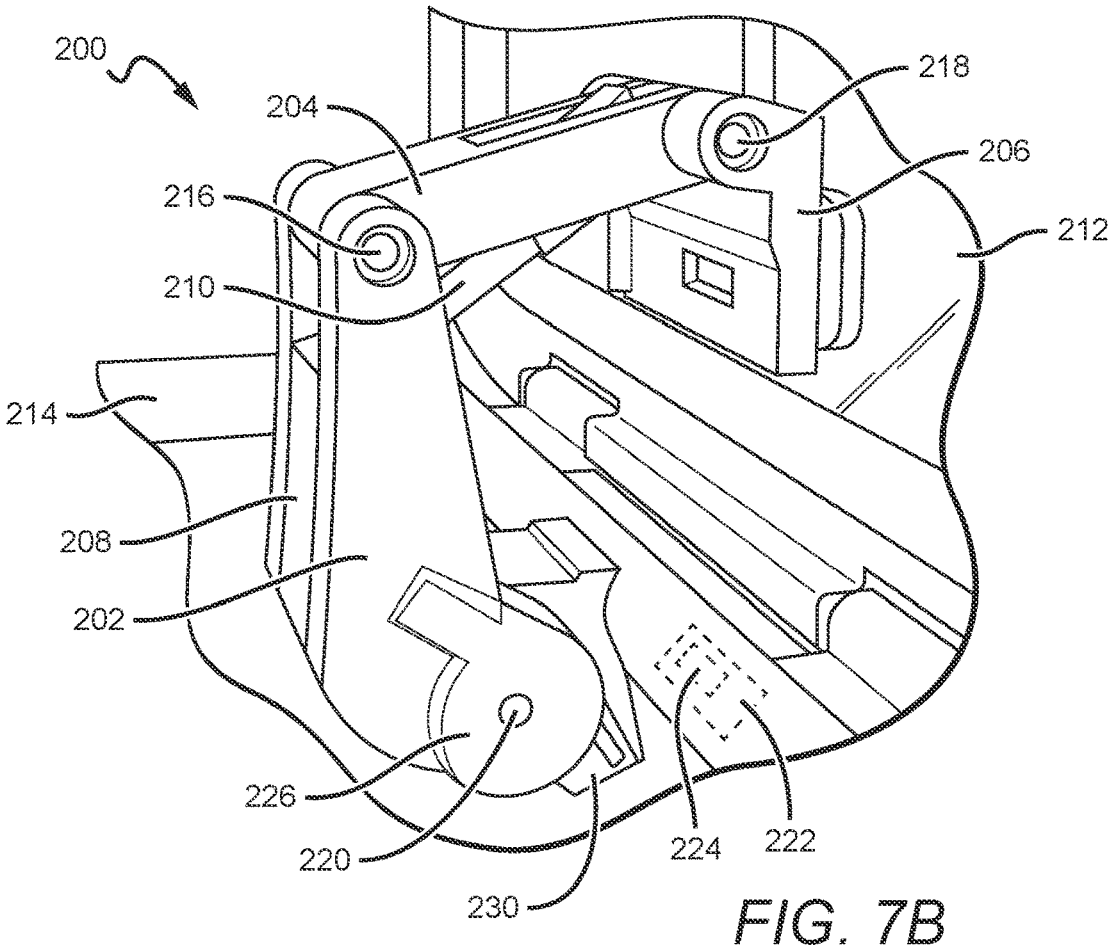
FIG. 7B shows the system of FIG. 7A in a partially open configuration.

FIGS. 7A-8C show an alternative embodiment of an actuation system 200 that implements a linear actuator instead of a rotational actuator (e.g., a DC motor), where the system is coupled with both a hatch lid 212 and a hatch base 214. FIG. 7A shows a hatch actuation system 200 with a hatch in a fully closed configuration. System 200 includes a first linkage 202, a second linkage 204, a lid bracket 206, and a hatch bracket 230. The first linkage 202 can include two arms with a coupling bracket 208 for linear actuator 210 to couple with. First linkage 202 couples with hatch bracket 230, which in turn couples with, e.g., hatch base 214. In some embodiments, the two arms and the coupling bracket 208 can be formed from the same stock of material or otherwise formed as a single component.

Likewise, second linkage 204 can be formed as one or multiple parts that are coupled together. Linear actuator 210 couples with both the first and second linkages 202 & 204. Linear actuator 210 couples with the first linkage 202 at the coupling bracket 208, and it couples with second linkage 204 such that the coupling point coincides with pin joint 218. In some embodiments, linear actuator 210 couples with first and second linkages 202 & 204 in locations other than at their pin joints. As shown in all of FIGS. 7A-8C, as linear actuator 210 extends, it causes the angle between the first linkage 202 and second linkage 204 to change, which in turn causes hatch lid 212 to open.

Figure 7C:
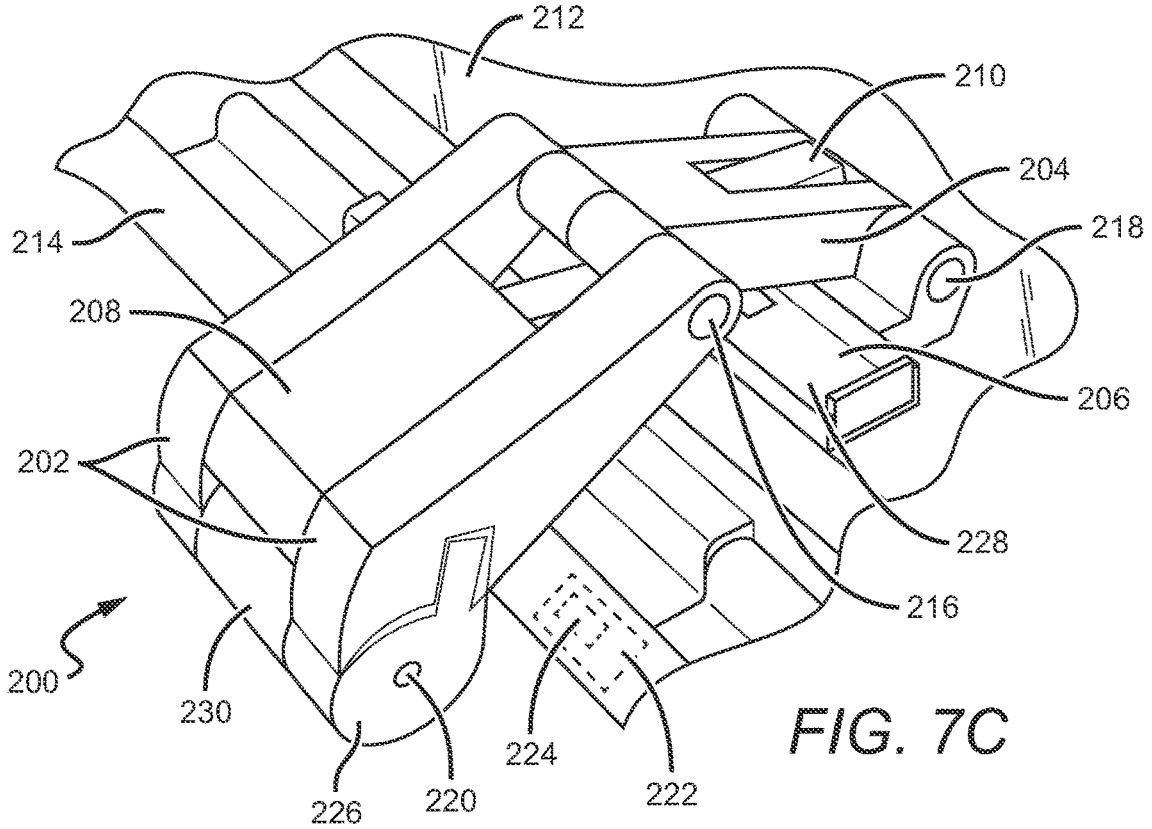
FIG. 7C shows the system of FIG. 7A in a fully open configuration.
Figure 8A:
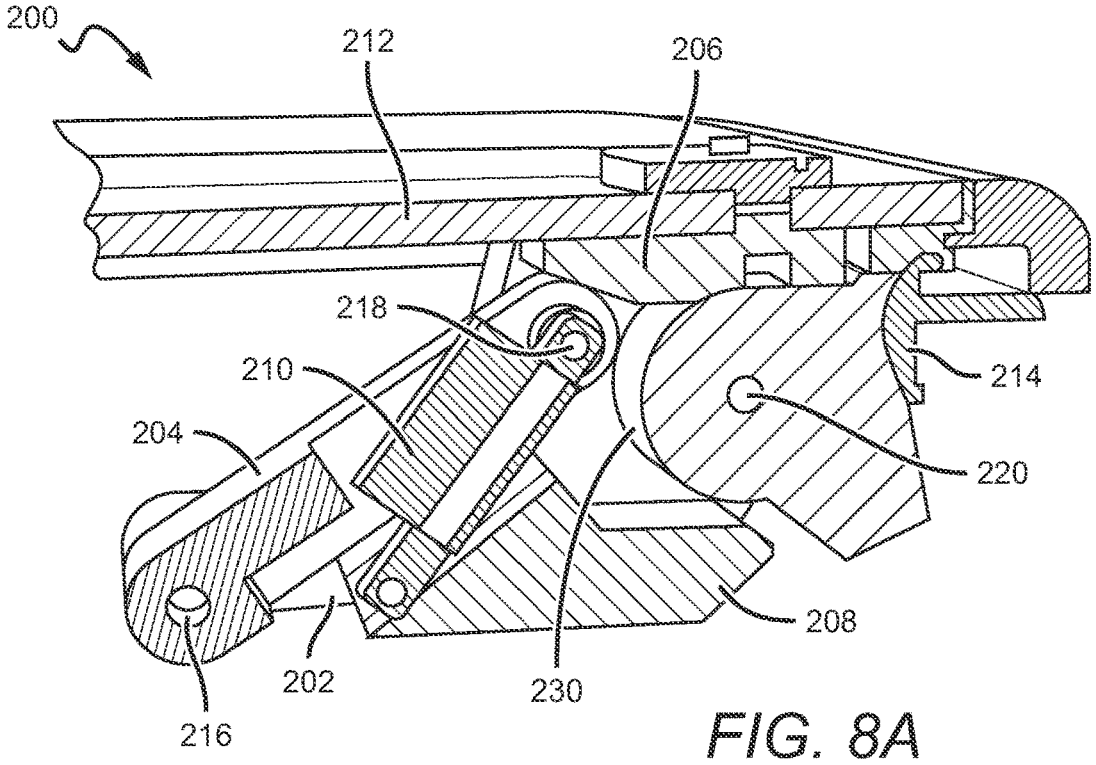
FIG. 8A shows a cutaway view of FIG. 7A.
Figure 8B:
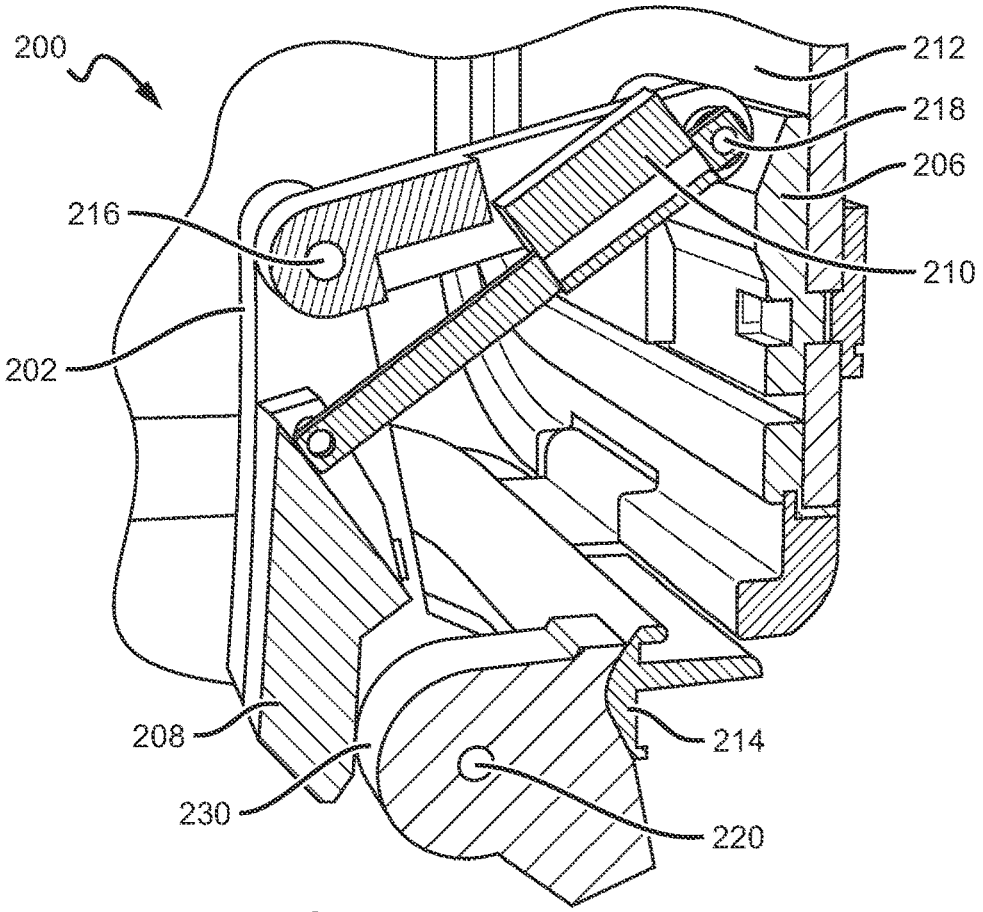
FIG. 8B shows a cutaway view of FIG. 7B.
Figure 8C:
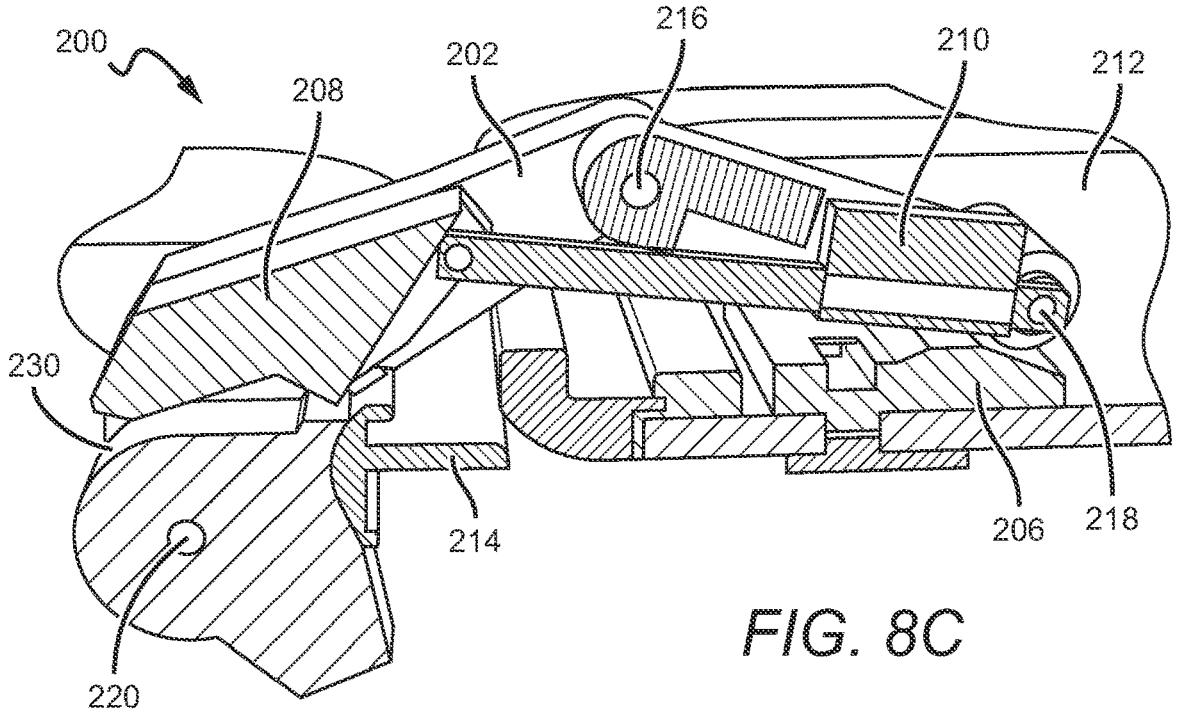
FIG. 8C shows a cutaway view of FIG. 7C.

Actuation system 200 can bring hatch lid 212 from fully closed to fully open, where fully open includes a full 180-degree rotation of hatch lid 212 relative to hatch base 214. FIG. 7C, for example, shows hatch lid 212 open approximately 180 degrees relative to hatch base 214. Some embodiments can open farther than 180 degrees, depending on the configurations of the linkages and where the linear actuator is coupled with the linkages.

As shown in all of FIGS. 7A-8C, linear actuator 210 couples with the first linkage 202 near pin joint 216 and with the second linkage at pin joint 218. This configuration improves the linear actuator's leverage to facilitate opening hatch lid 212. If the linear actuator were coupled on both linkages near pin joint 216, the amount of force required to cause hatch lid 212 to open could be greater than could be required in the configuration shown in FIGS. 7A-7C. Moreover, if linear actuator 210 were coupled with first linkage 202 near pin joint 220, when the system 200 is in the closed configuration (as shown in FIGS. 7A and 8A), the two ends of the linear actuator would be too close together, limiting the linear actuator's actuation range (e.g., how far the linear actuator can extend from its fully closed position).

Lid bracket 206 is like lid bracket 122 described above, and it can feature all or any subset of features described in association with lid bracket 122, including electronics, sensors, etc. It couples with an interior side of hatch lid 212, giving second linkage 204 a coupling point so that movement of the linkages causes hatch lid 212 to open or close. As with the embodiments described above, lid bracket 206 can include sensor package 228 as shown in FIG. 7C.

Sensor packages 222 & 228 can include one or any combination of a gyroscope, an accelerometer, and a magnetometer where combined sensors can be included in the same integrated circuit package (e.g., where each sensor is a MEMS sensor or combined into a single MEMS integrated circuit component). Sensor packages 222 & 228 can work together to improve reliability through redundancy as described above regarding sensor packages in system 100. For example, sensor package 222 can be included in some embodiments as a reference sensor package, where sensor package 222 is mounted on a non-moving portion of the structure or vehicle that a hatch is placed on, such as hatch base 214 or on hatch bracket 230. Meanwhile, sensor package 228 can be coupled with, e.g., hatch lid 212 or lid bracket 206 such that it remains stationary relative to hatch lid 212. This, as described above regarding system 100, creates two sets of measurements: a reference set of measurements from sensor package 222 as well as a set of hatch orientation measurements from sensor package 228. By comparing these measurements, hatch orientation can be determined even on dynamically moving vehicles, vessels, etc. In some embodiments, sensor packages 222 and 228 comprise a water sensor, an air pressure sensor, humidity sensor, temperature sensor, a carbon monoxide sensor, and a wind speed sensor.

In FIGS. 7A-8C, for example, sensor package 228 is stationary relative to hatch lid 212 because sensor package 228 is coupled with lid bracket 206. As another example where a hatch on a boat is automated using an embodiment of the inventive subject matter, sensor package 222 could be mounted such that it remains stationary relative to hatch base 214. It can be mounted directly to hatch base 214 or it can be mounted to another component or part that is stationary relative to hatch base 214 (e.g., not on a door, window, or any other component that can move independently from the body of the boat). In either case, sensor packages 222 & 228 can both couple with computer 224, which includes and facilitates all the features described in this application that require a computer. In some embodiments, as shown in FIG. 7A, torsion spring 226 can be included to create an opening or closing bias force about pivot 220.

Linear actuators can include an encoder that can be used to calculate the hatch lid position based on how far the linear actuator is extended/retracted, e.g., the linear actuator is extended 10 mm which correlates to a hatch lid angle of 15 degrees.

Because systems of the inventive subject matter are electronically controlled and implement a variety of sensor packages, they can do far more than just open and close a hatch with, e.g., a button press. To facilitate incorporation of a variety of different sensors, some embodiments can include a computing device capable of receiving sensor information and doing basic data processing (e.g., an Arduino system or the like). Thus, some systems can further include a wide variety of different sensors to introduce new behaviors to a hatch. Systems can implement one or any combination of a water sensor, a thermostat, a barometer, an anemometer, a hygrometer, a gyroscope, a carbon monoxide sensor, and a smoke detector into any of the sensor packages discussed above. This list of sensors should not be considered comprehensive, and the inventors expressly contemplate that additional sensors can also be included that are not listed in this application. It is contemplated that a system of the inventive subject matter can receive, via its computing device, sensor information from sensors from an existing system (e.g., a boat's existing sensors or data from existing weather stations). Thus, in some embodiments, especially on new construction or builds, existing on-board sensors and other external weather databases can transmit sensor data to the system, which the system can use to improve its functions.

Carbon monoxide detectors and smoke detectors can be implemented into systems of the inventive subject matter to improve safety. For example, in a system implemented on a boat, if carbon monoxide is detected in the boat's cabin by a sensor package disposed on an interior side of a hatch due to improper venting from a galley area, a carbon monoxide detector would transmit a signal to a computing device that immediately causes one or more hatches (including the hatch to which the system is coupled) to open to vent fresh air into the cabin, while simultaneously putting out an alert that carbon monoxide levels are too high. The same is true for a smoke detector. Automatically opening hatches when smoke is detected can allow smoke to vent out, improving visibility and potentially saving lives.

A water sensor, as discussed above, can detect the presence of liquid water and that information can be transmitted to a user with remote control of a hatch. Thus, if the sensor detects there is water, a user might decide not to open the hatch. Similarly, a hatch can be configured to automatically close if it detects water to prevent water from, e.g., entering a boat's cabin. Systems of the inventive subject matter can include water sensors both inside and outside of a hatch. Including a water sensor on the interior side of a hatch, e.g., can allow a system of the inventive subject matter to detect the presence of water even when a hatch is fully open and a sensor on the other side of that hatch is sheltered. In some embodiments, a water sensor can be placed on the outside of a hatch but mounted adjacent to the hatch (and outside of the hatch's path to open and close) so that opening or closing the hatch does not interfere with its ability to detect water. Having two sensors (one inside and one outside of a hatch) can be beneficial for any sensor described in this application, and although locations of sensors described in this application may not be expressly discussed, it should be understood that they may be mounted as described in this paragraph.

Some embodiments include two thermostats, e.g., one in a boat's interior and one outside. Information about the difference in temperature between the inside of the boat and the outside of the boat can be used to automatically control a hatch to regulate temperature. For example, if it's cooler outside than inside and a user has set a desired temperature range that the interior has exceeded, then the computing device can determine that the hatch should be opened to cool the cabin.

A barometer can be implemented to detect an incoming weather system (e.g., a change in barometric pressure) and close a hatch. For example, before encountering a low-pressure system likely to have rain or a high-pressure system likely to have strong winds, a barometer would detect a change in barometric pressure indicating the shifting weather. Similarly, an anemometer can be implemented to detect and record instantaneous wind speed, and wind speed information (e.g., instantaneous, a running average, etc.) can subsequently be interpreted to make a decision about when to close a hatch. For example, a user can set a wind speed threshold, above which a hatch will automatically close. Additionally, a hatch can close according to a linear relationship with wind speed (e.g., as wind speed increases, the hatch is closed more and more up to a certain threshold at which the hatch is fully closed). This behavior can be implemented to moderate internal air currents and reduce pressure on the hatch lid when it experiences the forces of high wind speeds. High wind speeds can, in some situations, increase a motor's load when closing a hatch, which can in turn damage the motor or other components.

A hygrometer can be implemented to determine whether to close a hatch based on a detected humidity. For example, rain systems are often preceded by elevated humidity, so when a hygrometer detects relative humidity has exceeded some threshold, that information can be used to cause a hatch to close. Conversely, a hatch lid can be closed when low humidity is detected that often relate to using an air-conditioner, A gyroscope can also be implemented, e.g., in the context of watercraft to measure a vessel's orientation, and that information can be used to automatically close a hatch. For example, when conditions for capsizing are detected or when large swells result in a boat experiencing excess tilting, the hatch can be automatically closed to minimize the ingress of water. Similarly, an accelerometer can be used to detect forceful tilting or rocking of the vehicle, such as large swells roughly rocking a boat from side to side.

In addition to sensors, externally collected information can be used by systems of the inventive subject matter to further influence hatch control. For example, weather information can be collected from any number of databases (e.g., the National Weather Service, the European Centre for Medium-Range Weather Forecasts, etc.) and used to help determine when a hatch can be opened or closed based on an expected weather pattern. For example, if a weather service indicates an incoming cold front with thunderstorms, that information can be used to close all hatches on a building, vessel, or vehicle before radar indicates rain will begin. Of course, any one or combination of sensors described above can be used in combination with weather data to further improve hatch opening and closing determinations. In some embodiments, for example, systems of the inventive subject matter can receive and use information (e.g., weather information or sensor information from other systems of the inventive subject matter) from other nearby vessels, buildings, or vehicles. This information can be gathered wirelessly (e.g., by radio, cell network, or any other type of wireless connection). This feature allows automated hatches near each other to better anticipate conditions requiring hatch actuation. In some embodiments, systems of the inventive subject matter can be configured to transmit sensor information to a remote server or set of servers (e.g., a cloud) when an internet connection is available. In the context of boating, for example, this would allow systems to access information from nearby vessels even if those vessels are not close enough for a direct connection or are otherwise not currently transmitting data wirelessly. Periodic uploads to cloud servers can also reduce internet connection up time, reducing battery demand.

In some embodiments, systems of the inventive subject matter can additionally include a solar power generating subsystem 402 (FIG. 11) along with a battery backup. A solar subsystem can also be useful to reduce power demands of the system. In many situations, hatches can be left alone for many hours or days at a time. In embodiments with a solar subsystem, solar energy can be converted to electricity and stored in a battery that can be used to open and close the hatch by activating the various electromechanical systems required to make the system work.

Because systems of the inventive subject matter are intended to be used with buildings, vehicles, watercraft and other applications (e.g., anywhere that a hatch can be implemented, so too can systems of the inventive subject matter) that are frequently exposed to water and other weather conditions, it can be advantageous to use corrosion-resistant materials (e.g., metal components can have a protective coating, and other components can be made from plastics, corrosion resistant metals, or composites). This can be especially useful for vessels that are used in saltwater. In some embodiments, fireproof or fire-resistant materials can be used for all or some components of systems of the inventive subject matter.

Figure 9:
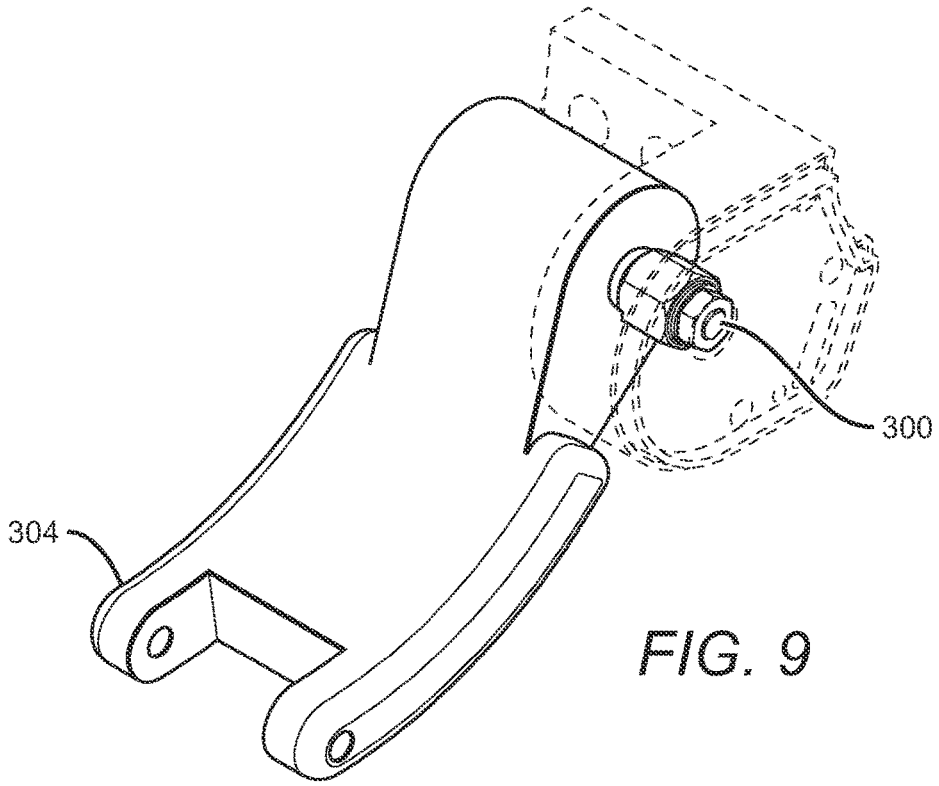
FIG. 9 shows a hinge having a tension hinge bolt.
Figure 10:
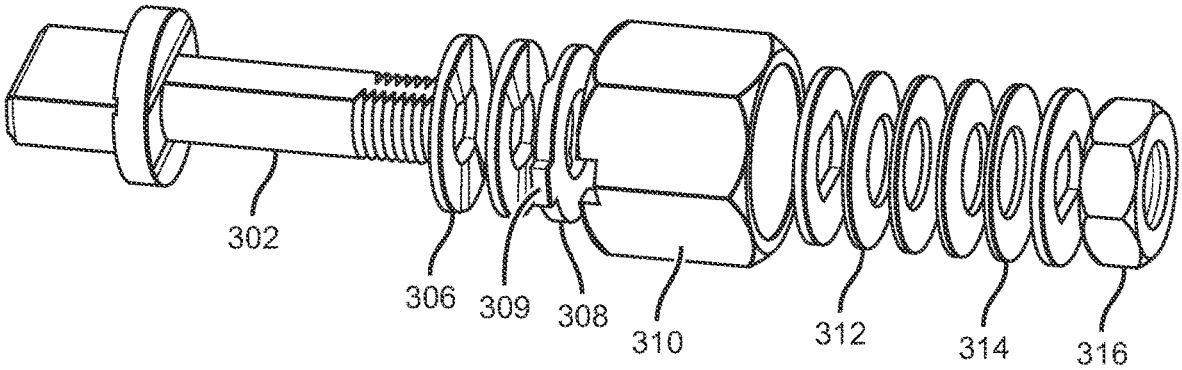
FIG. 10 shows a tension hinge bolt.

It is additionally contemplated that a hatch outfitted with a system of the inventive subject matter can additionally include a tension hinge 300 as shown in FIG. 9. Tension hinge 300 includes bolt 302, shown in FIG. 10, with a head shaped to couple with the cavity of, e.g., lever arm 304. Bolt 302 has two flat surfaces on either side that couple with friction plates 306 that have small ridges. A fixed plate 308 rigidly couples to friction plate housing 310 via two tabs 309 on either side of fixed plate 308. Friction plate housing 310 is then placed over bolt 302. Then, alternating convex 312 and concave 314 plates are placed over bolt 302. Friction is applied and varied by the locking nut 316 which presses the convex 312 and concave 314 plates together. It is contemplated that tension hinge 300 can be incorporated into any of the axles (e.g., pin joints or other single degree of freedom points of rotation) of systems of the inventive subject matter.

Figure 11:
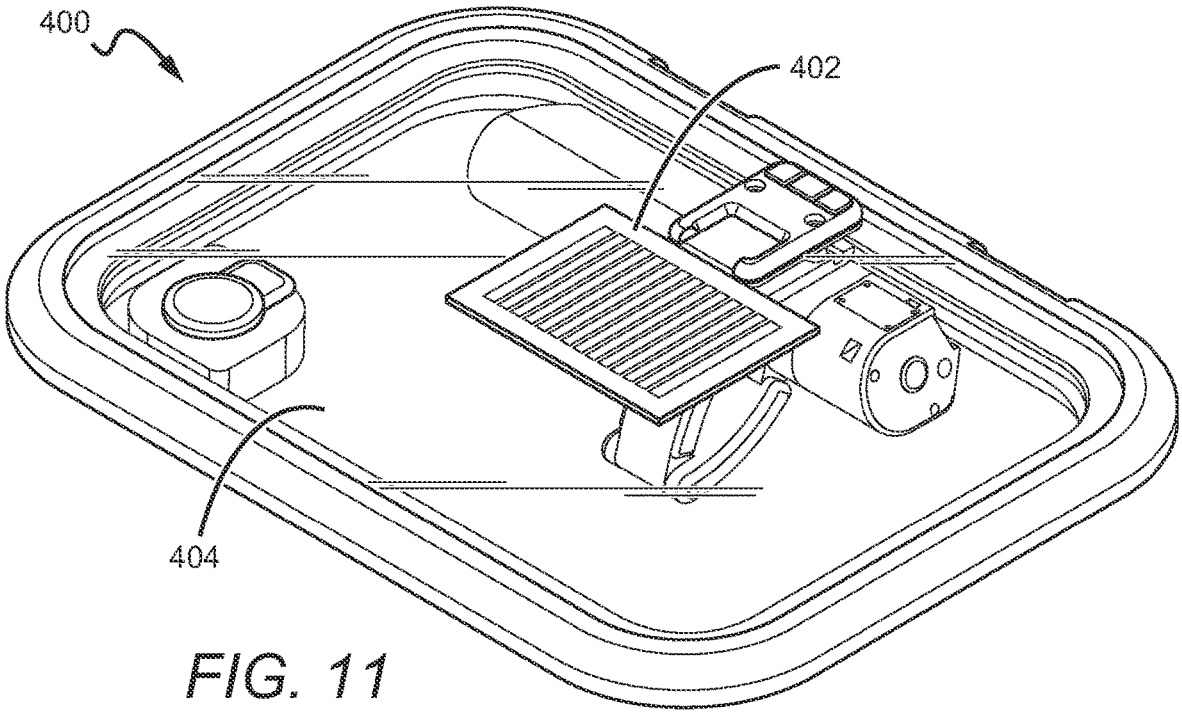
FIG. 11 shows an embodiment having a solar panel.

FIG. 11 shows a hatch with a system 400 of the inventive subject matter that additionally includes a solar panel 402. Solar panel 402 is coupled with hatch lid 404. All other components are similar or identical to those described regarding FIGS. 1-6.

Thus, specific systems and methods directed to hatch opening and closing automation systems have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A lid actuation system comprising:

an actuation subsystem having a motor, a gearbox coupled with the motor, a first linkage fixedly coupled with an output from the gearbox, and a second linkage coupled with the first linkage by a pin joint;

wherein the actuation subsystem is configured to couple with a base;

a lid subsystem having a lid bracket coupled with the second linkage by a second pin joint;

wherein the lid bracket is configured to couple with a lid that is hingedly coupled with the base;

wherein the lid comprises a surface that is sized and dimensioned to cover an opening;

wherein the lid bracket couples with the surface of the lid and a sensor package couples with the lid bracket on an exterior side of the surface of the lid, where the lid bracket and the sensor package are co-located on the surface of the lid; and wherein an axis of rotation of the output from the gearbox is parallel to an axis of rotation of the lid.

2. The system of claim 1, further comprising a second sensor package, wherein the second sensor package is coupled with the actuation subsystem on an interior side of the surface of the lid.

3. The system of claim 2, wherein the second sensor package comprises at least one of a water sensor, a hygrometer, an anemometer, a barometer, a thermometer, a MEMS gyroscope, a MEMS accelerometer, and a MEMS magnetometer.

4. The system of claim 2, further comprising an enclosure configured to at least partially enclose the second sensor package, wherein the enclosure has an air inlet and an air outlet to allow air currents to pass over the exposed sensors contained therein.

5. The system of claim 2, wherein the second sensor package further comprises a cover and at least one input.

6. The system of claim 1, wherein the sensor package comprises at least one of a water sensor, a hygrometer, an anemometer, a barometer, a thermometer, a MEMS gyroscope, a MEMS accelerometer, and a MEMS magnetometer.

7. The system of claim 1, further comprising a rotary encoder coupled with the motor.

8. The system of claim 1, wherein the first linkage comprises a curved portion and the second linkage comprises a curved portion.

9. The system of claim 1, further comprising a torsion spring coupled with the first linkage.

10. The system of claim 1, further comprising a tension hinge coupled with the first linkage.

11. The system of claim 1, further comprising a solar panel coupled with an exterior side of the lid.

12. The system of claim 1, wherein the sensor package comprises a water sensor.

* * * * *